United States Patent [19]

Scrivens

[11] 4,043,230

[45] Aug. 23, 1977

[54] ALLEN WRENCH HOLDER

[75] Inventor: Eugene G. Scrivens, Shaftsbury, Vt.

[73] Assignee: The Raymond Lee Organization, Inc., New York, N.Y.

[21] Appl. No.: 665,044

[22] Filed: Mar. 8, 1976

[51] Int. Cl.[2] ..... B25B 13/00

[52] U.S. Cl. ..... 81/177 A; 81/71; 81/177 M

[58] Field of Search ..... 81/57.5, 71, 177 R, 81/177 A, 177 E, 177 M; 279/9 R

[56] References Cited

U.S. PATENT DOCUMENTS

| | | | |
|---|---|---|---|
| 2,346,364 | 4/1944 | Dowe | 81/71 UX |
| 2,539,532 | 1/1951 | Daniels | 81/177 E X |
| 2,593,828 | 4/1952 | Arey | 81/177 A X |
| 2,672,777 | 3/1954 | Dossie | 81/71 X |
| 2,715,028 | 8/1955 | Dossie | 81/71 X |

*Primary Examiner*—Al Lawrence Smith
*Assistant Examiner*—James G. Smith
*Attorney, Agent, or Firm*—Howard I. Podell

[57] ABSTRACT

A holder for retaining individual hexagonal wrenches of a set of the type known as Allen wrenches. The holder is in the form of a cylindrical member fitted with a plurality of through parallel transverse wrench holes, each wrench hole of the size to retain a specific size wrench. A set screw is individually threaded in a hole intersecting and transverse to each wrench hole for tightening about a wrench in the wrench hole. A cap member is fixed to one end of the cylindrical member by a pair of flush mounted cap screws, with the holder fitted with a shaped recess open to the capped end of the cylindrical member for retention of small wrenches.

1 Claim, 5 Drawing Figures

ALLEN WRENCH HOLDER

SUMMARY OF THE INVENTION

My invention is a holder for retaining individual hexagonal wrenches of a set of tye type known as Allen wrenches. The holder is in the form of a cylindrical member fitted with a plurality of through parallel transverse wrench holes, each wrench hole of the size to retain a specific size wrench. A set screw is individually threaded in a hole intersecting and transverse to each wrench hole for tightening about a wrench in the wrench hole. A cap member is fixed to one end of the cylindrical member by a pair of flush mounted cap screws, with the holder fitted with a shaped recess open to the capped end of the cylindrical member for retention of small wrenches.

By means of my invention each large wrench of a set of Allen type wrenches may be individually retained in place by an individual set screw, with the small wrenches retained in a recess closed by a bolted cap.

BRIEF DESCRIPTION OF THE DRAWINGS

The objects and features of the invention may be understood with reference to the following detailed description of an illustrative embodiment of the invention, taken together with the accompanying drawings in which.

DESCRIPTION OF THE PREFERRED EMBODIMENT

Figure 1:
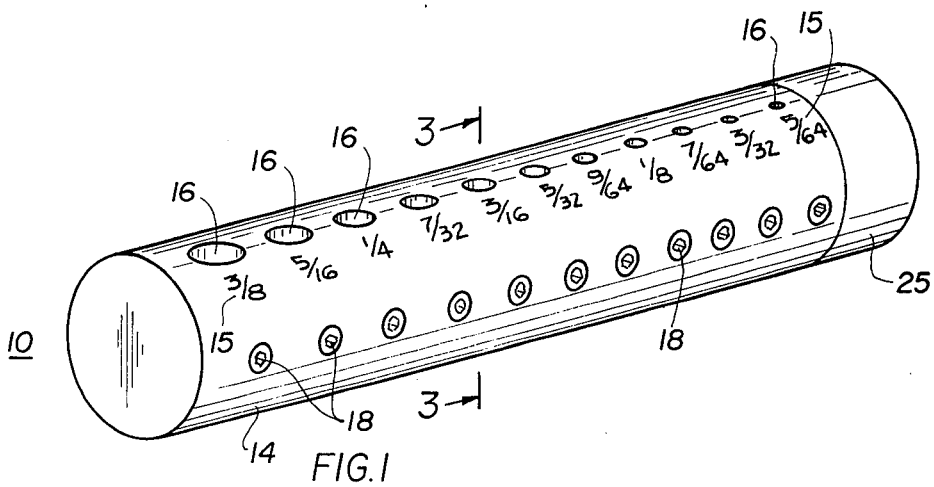
FIG. 1 is a perspective view of the holder.
Figure 2:
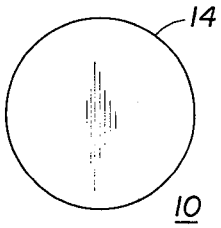
FIG. 2 is a bottom plan view of the holder.
Figure 3:
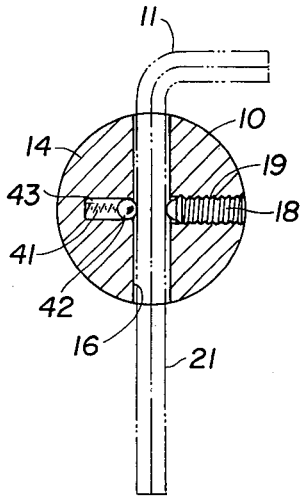
FIG. 3 is a sectional view of the holder, taken through line 3—3 of FIG. 1.
Figure 4:
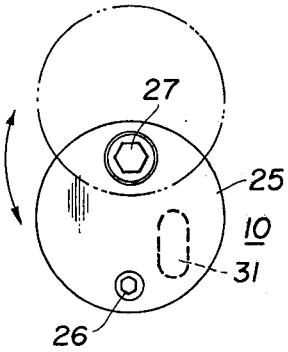
FIG. 4 is a top plan view of the holder.
Figure 5:
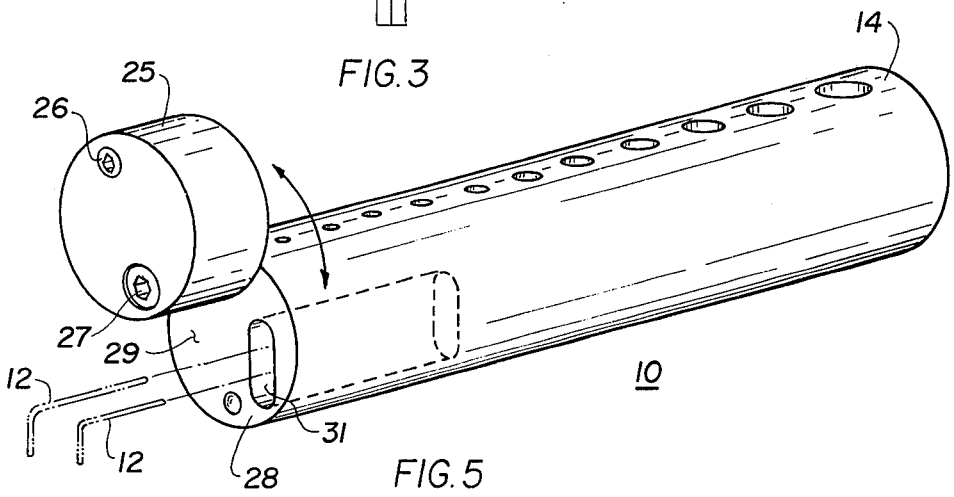
FIG. 5 is a perspective view of the holder in an open position.

Turning now descriptively to the drawings, in which similar reference characters denote similar elements throughout the several views, FIGS. 1–5 illustrate the wrench holder 10 which is adaptable for fixed retention of bent hexagonal wrenches 11 of different sizes of the type known as Allen wrenches, and for enclosed secured retention of small wrenches 12 of the same type.

The holder 10 is in the shape of a cylindrical solid body section 14 in which a plurality of parallel through holes 16 of different sizes are formed with insignia markings 15 marked on the exterior surface 17 of the holder, such that each hole 16 is identified with the size of a hexagonal wrench 11 that is to be retained in that hole.

A plurality of set screws 18 are individually retained in a plurality of threaded holes 19 with each hole 19 intersecting a through hole 16, and preferably perpendicular to the axis of each through hole 16.

Each set screw 18 is adaptable for tightening against a flat surface 21 of a hexagonal wrench 11 lying in the associated hole 16, and set screws 18 are preferably of a length so as not to extend beyond the exterior surface 17 of the holder, in the tightened mode.

A solid cap member 25 of similar cross-sectional dimensions as the body section 14 is bolted by two cap screws 26 and 27 against the top end 29 of the body section 14 so as to extend, in the fastened mode as a continuation of the body section 14. Screws 26 and 27 are each located at a distance from the central longitudinal axis of body section 14 that that loosening of one cap screw 26 from engagement with body section 14, and slight loosening of the other cap screw 27, permits cap 25 to rotate in a non-centric relation to body section 14, so as to uncover an internal shaped recess 31 in body section 14 that extends from top end 29. Recess 31 is of a length and a non-circular cross-section of a size to accommodate bent hexagonal wrenches 12 of smaller size than may be readily accommodated in the smallest body hole 16.

Both cap screws 26 and 27 are flush mounted to cap 25, and one of the screws 26 may alternately be a headless set screw.

Similarly headless set screws 18 may be cap screws flush mounted in the body section 14.

Preferably all screws 18, 26 and 27 are formed with hexagonal recessed sockets for use with wrenches of the type retained in the holder. The wrenches 11 necessary for rotation of such screws 18, 26 and 27 may be alternately retained in body holes 16 by means of a ball detent 42 mounted in an internal transverse hole 43 by a compression spring 41, as an alternate means of retention to set screws 18, so that they may be retained in a hole 16 after employment for tightening a set screw 18.

Alternately such spring detent means may be substituted for all set screws 18.

Since obvious changes may be made in the specific embodiment of the invention described herein, such modifications being within the spirit and scope of the invention claimed, it is indicated that all matter contained herein is intended as illustrative and not as limiting in scope.

Having thus described the invention, what I claim as new and desire to secure by Letters Patent of the United States is:

1. A holder for retention of hexagonal section L-shaped wrenches comprising a body member formed with a plurality of parallel through holes, each of a different cross-section from the others, with the center of each hole located substantially along a straight line, with positive fastening means for individual retention in each hole of a hexagonal wrench, in which the positive fastening means comprise a screw mounted in a threaded hole that intersects and is transverse to the axis of the through hole, said body member fitted with a shaped internal recess, open at one end of the body member, together with a solid cap mounted by two cap screws to said end so as to serve as a closure for said recess, said cap screws each located a distance from the longtudinal axis of the body member, so that removal of one screw permits the cap to pivot about the other screw so as to uncover said recess, with said recess of non-circular cross-section, and of a length and cross-section to retain a bent L-shaped hexagonal wrench of a size smaller than that accommodated by the through holes of the body.

* * * * *